United States Patent [19]

Ashihara

[11] Patent Number: 4,978,123

[45] Date of Patent: Dec. 18, 1990

[54] RACKET WITH ROTARY CROSSHANDLE

[76] Inventor: Hiyuki Ashihara, 360-1, 8-chome, Sanbancho, Matsuyama-shi, Ehime-ken, Japan

[21] Appl. No.: 381,924

[22] Filed: Jul. 19, 1989

[30] Foreign Application Priority Data

Jul. 21, 1988 [JP] Japan ..... 63-182888

[51] Int. Cl.[5] ..... A63B 49/08

[52] U.S. Cl. ..... 273/73 R; 273/73 J; 273/67 R

[58] Field of Search ..... 273/73 R:73 J, 67 R, 273/67 DA, 67 DB, 84 R

[56] References Cited

U.S. PATENT DOCUMENTS 4,252,317 2/1981 Vezina ..... 273/81.2
4,360,201 11/1982 Biehl et al. ..... 273/73 C
4,861,030 8/1989 Burt ..... 273/73 J

FOREIGN PATENT DOCUMENTS 896.459 8/1983 Belgium .
3616414 11/1987 Fed. Rep. of Germany .
2528319 12/1983 France ..... 273/73 J
2576219 7/1986 France .

*Primary Examiner*—William H. Grieb
*Attorney, Agent, or Firm*—Armstrong, Nikaido, Marmelstein, Kubovcik & Murray

[57] ABSTRACT

A novel racket for sporting isoffered, with featuring that a crosshandle is added on a shaft of a conventional racket, with a size suitable for hand gripping and is structurally comprised of a plurality of grip members, wherein at least one of the grip members is rotatably mounted, free from a motion of the crosshandle which is integrally connected with a racket so that a user can manually swing the racket with gripping the crosshandle as a pivotal axis. Conventional rackets are used in many sporting events to hit a ball, but this are depends largely on muscular strength, and thereby the muscular weak, elderly people and females, are prone to become unfamiliar to such a nature of sporting. The invention crosshandle racket can utilize a pivotal action to produce centrifugal force in hitting an on-coming ball so that musclar strength may be saved. A new sporting event may be created with use of the inventive racket.

10 Claims, 8 Drawing Sheets

RACKET WITH ROTARY CROSSHANDLE

FIELD OF THE INVENTION

This invention relates to a novel racket for sporting.

INTRODUCTION TO THE INVENTION

Tennis, badminton, and table tennis are very popular sporting events, in which a racket is used to hit a ball or a shuttle (in the following, for convenience, the shuttle is included into the ball). The way of hitting a ball in these kinds of conventional sportings is to hit by power of musular strength.

Therefore, the outcome of a game is largely dependent on the player's physical ability, which requirement often attenuates attraction to such sporting events and also limits volunteers who want to enjoy playing such a nature of sporting. This trend is particularly true with elderly people or females who are not strong at muscular power. Then, they are prone to become unfamiliar with enjoying a ball-hitting sporting event.

In view of such background with conventional events having the nature of ball-hitting plays, this invention introduces a novel racket which does not depend largely on a player's muscular power. That is, those of wide generations including the elderly aged and females, the physically weak, may enjoy a ball-hitting game with use of the inventive racket.

SUMMARY OF THE INVENTION

This invention basically features in adding a crosshandle to a conventional racket, and more particularly, features adding a crosshandle at a place on a shaft of a racket, wherein the crosshandle is contrived to be rotatable manually so that a user can swing the racket with gripping the crosshandle as a pivotal axis, by which way the player is allowed to exert centrifugal force to an on-coming ball, instead of muscular strength.

So far the inventive racket is referred to in view of tennis and table tennis. Then, in tennis a player is allowed to hit a ball before it bounces on the ground and also after one bounce or rebound. Badminton allows a player to only to hit the shuttle before it bounces on the ground. This inventive racket is rather appropriate to the type of tennis.

And as will be apparent, this disclosure relates to a racket with a crosshandle and also a crosshandle to be fitted to a racket.

BRIEF DESCRIPTION OF THE DRAWINGS

FIGS. 1 to 3 show different views of an embodiment of the inventive crosshandled racket, wherein FIG. 1 is a front view thereof, FIG. 2 is a right side view, and FIG. 3 is a plan view thereof.

FIGS. 11 and 12 show another embodiment, wherein FIG. 11 is a front view and FIG. 12 is a sectional view along the line I—I in FIG. 11.

FIGS. 13 to 15 show still another embodiment, wherein FIG. 13 is a front view and FIG. 14 is a sectional view along the line II—II in FIG. 13, FIG. 15 is a sectional view along the line III—III in FIG. 13.

FIGS. 16 and 17 show still further another embodiment, wherein FIG. 16 is a front view and FIG. 17 is a sectional view along the line IV—IV in FIG. 16.

These drawings are presented to illustrate the invention and therefore these should not be construed as limiting the invention. In the following, a like numeral indicates a like part, and "crosshandle" is sometimes noted "handle" for brevity.

DESCRIPTION OF THE EMBODIMENTS

Figure 1:
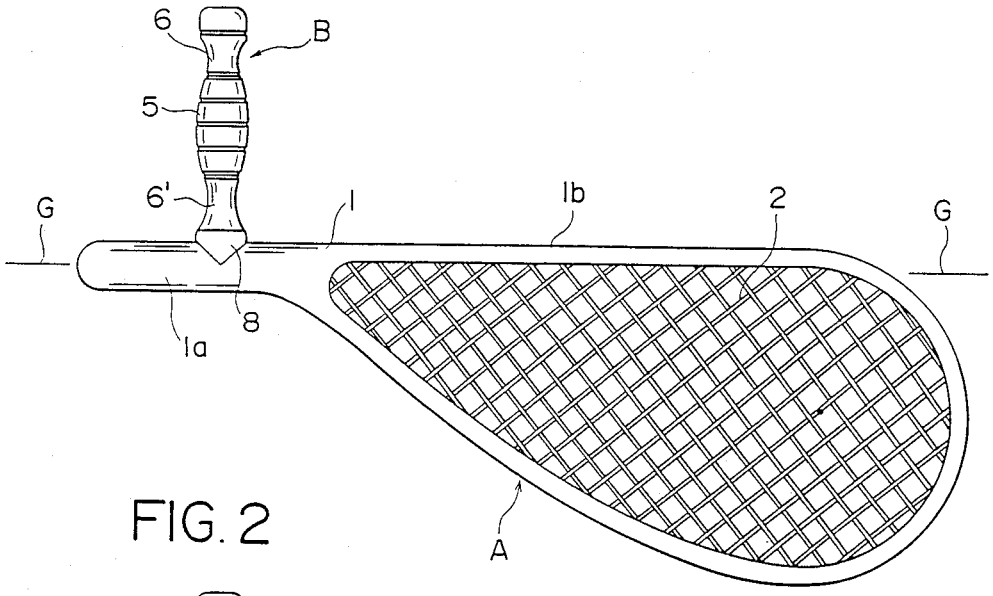
Figure 2:
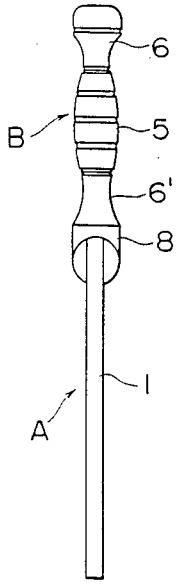
Figure 3:
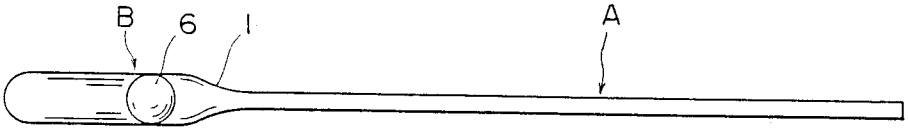

With reference to FIGS. 1 to 3, this embodiment is designed to be suitable to a kind of table tennis or a miniture ground tennis. A is a racket and B is a crosshandle. 1 is a frame of a racket A. 1*a* is a shaft of the racket A, and the frame 1 and the shaft 1*a* define a racket body of the racket A. 2 is a gut, wherein the handle B is provided to be vertical to the shaft 1*a* or the upper edge line 1*b* of the frame 1 and also provided to be co-planar or flush with a plane defined by the frame 1, and the handle B is suitably shaped to be like a bowling pin, with a size suitable to a man's handgrip; normally, 10–15 cm in length and 3–4 cm in average diameter. A line G indicates a longitudinal center or balance line, of which significance will be apparent as the description proceeds. And therein, said line 1*b* is straight, but not round, which is designed for consideration that the line 1*b* is supposed to be beside a user's body and then not to be obstructive to playing actions, wherein the handle B acts as counterbalance to the racket body comprised of the racket frame 1 and shaft 1*a*, which is resident on the other side of the line G.

Referring to internal structures of the handle B based on FIGS. 4 to 6, 3 is a support shaft which feeds through internally of the handle B and is secured at its bottom 3*a* to the shaft 1*a*, wherein the way of securing may be a tenon-mortise coupling, a tapping and thread engagement or the like as known conventionally.

8 is a mounting base or saddle base which is mounted on the shaft 1*a* to act as a base to build thereon the handle B by laying over a few grip members as will be noted in the following description.

Figure 4:
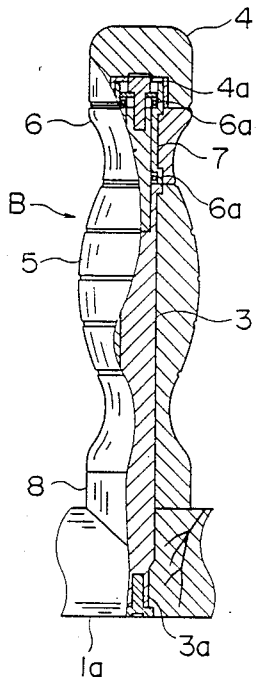
FIGS. 4 to 6 show front views of a crosshandle with a break to expose internal structures of the crosshandle which is fitted on a shaft of a racket.

Upon the mounting base 8, a few grip members are laid on one another to form a stand sheathing the support shaft 3. In the case of FIG. 4, involved are a main grip 5 which is integral to the base 8 and firmly clamped around the shaft 3, an upper grip 6 which supports the shaft 3 rotatably with aid of ball bearings 6*a*, 6*a*, and a sleeve 7, which is interleaved between inside of the upper grip 6 and the ball bearings 6*a*, 6*a*, and a cap member 4 which fits over a top of the shaft 3 with thread engagement 4*a*.

Figure 5:
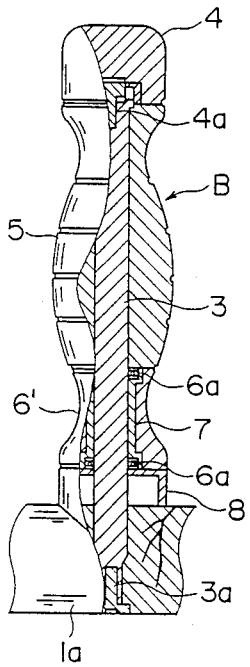

In the case of FIG. 5, on the base 8, first laid is a lower grip 6' which supports the shaft 3 rotatably, in much the same way as above, with aid of ball bearings 6*a*, 6*a* and a sleeve 7.

Figure 6:
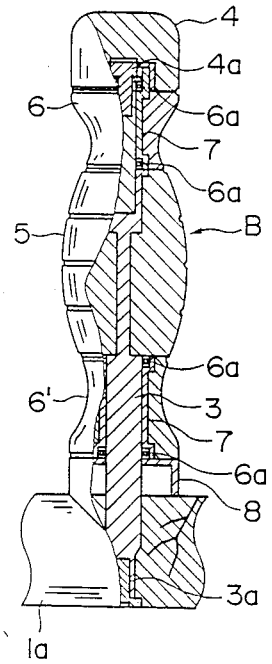
Figure 7A:
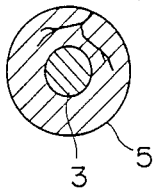
FIG. 7 (*a*) to (*f*) show different sectional views of the crosshandle.
Figure 7B:
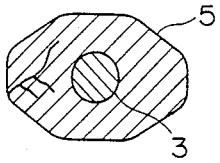
Figure 7C:
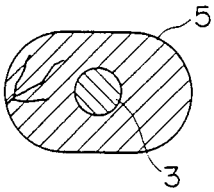
Figure 7D:
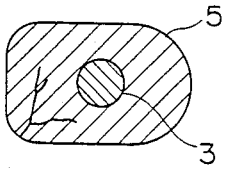
Figure 7E:
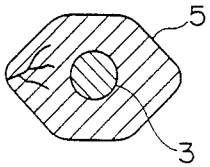
Figure 7F:
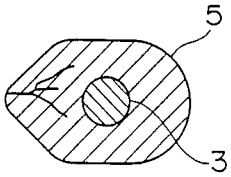

In the case of FIG. 6, on the base 8, first laid is a lower grip 6' which supports the shaft 3 rotatably in much the same way as above, and second laid is a middle grip 5 which clamps around the shaft 3, and third laid is an upper grip 6 which supports the shaft 3 rotatably in much the same way as above.

In summary, in the embodiment shown in FIG. 4, the upper grip 6; in FIG. 5, the lower grip 6'; in the FIG. 6, the lower and upper grips 6', 6; these specified grip(s) in each embodiment acts, with aid of rotatable structure, independently of other grip member(s) when the handle B is gripped in the palm.

It is to be noted here that, in use, the crosshandle B is gripped first as a whole and then the racket A is turned, and while turning the racket, the rotatably free grip member(s) (the member numered 6 or 6' in the above, and in the following, this kind of grip member is sometimes noted "rotatable member") should be gripped and non free grip member(s) should be released, because the non free member(s) acts integrally with the racket to turn.

In above structures, when the sleeve 7 is made of a lubricating material, the ball bearings 6*a* may be saved.

FIG. 7 shows several different sectional views of the portion 5, noted as middle grip or main grip in the above. As is conceived, a cross sectional shape may be round or circular or of elongate non-circular form such as elliptic, or half round with gentle angle(s).

Figure 8:
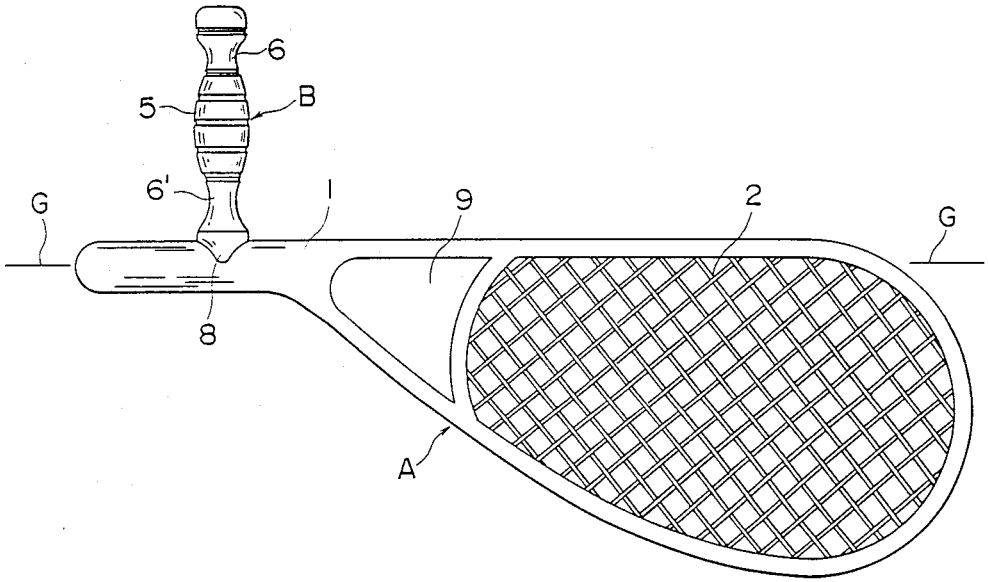
FIGS. 8 to 10 respectively show a few other inventive embodiments.
Figure 9:
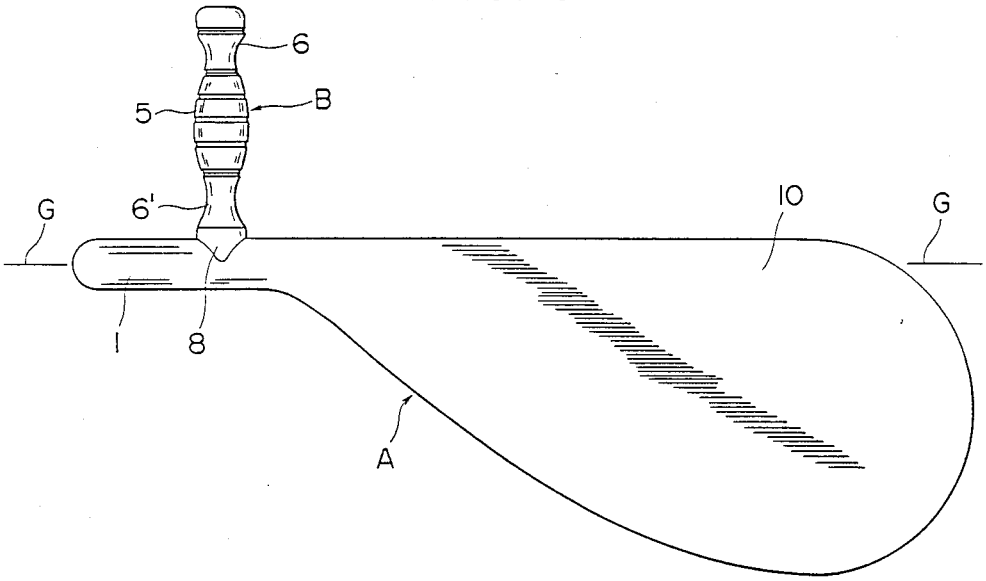

Referring to FIG. 8, this shows an embodiment equipped with a handle B in the form of FIG. 6, and the racket shown has a gut 2 and a neck opening 9. FIG. 9 shows an embodiment equipped with a handle B in the form of the same as above, and the racket has a plate 10 which is integrated with the frame 1 and is assumed to be included in the frame 1 in literal expression. As is understood, embodiments in FIGS. 8 and 9 are equipped with the handle B as counterbalance to the racket body resident on the other side of the line G.

Figure 10:
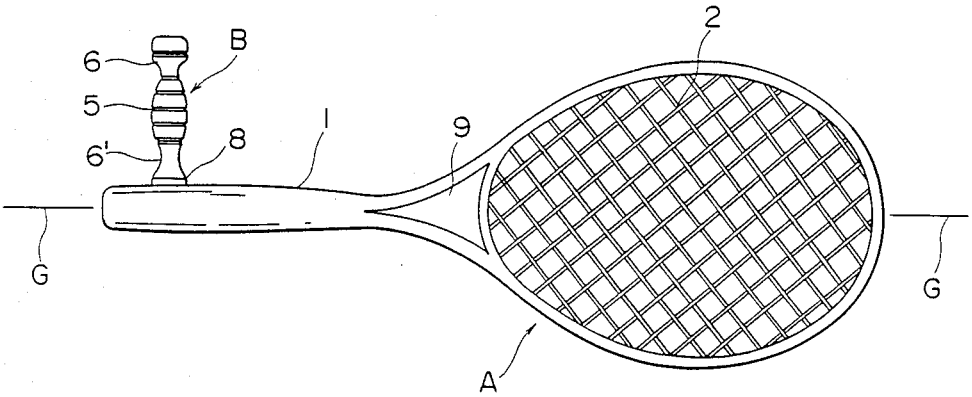

FIG. 10 shows an embodiment equipped again with a handle B in the same way, and the frame is shaped like an egg, much in the same as a tennis racket.

Figure 11:
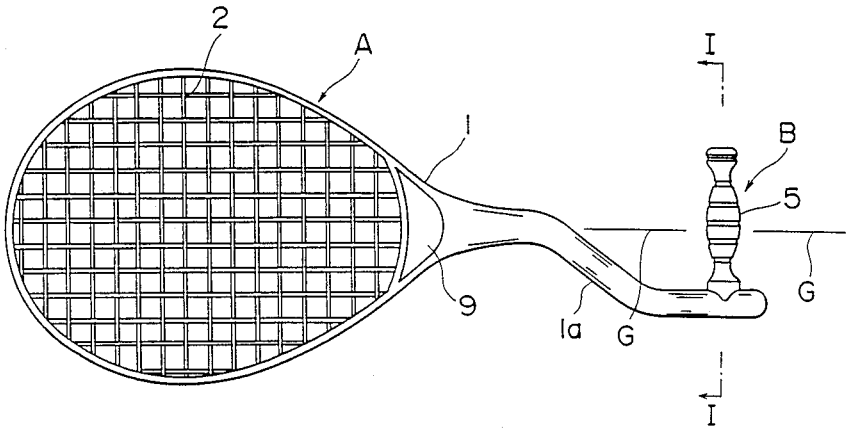
Figure 12:
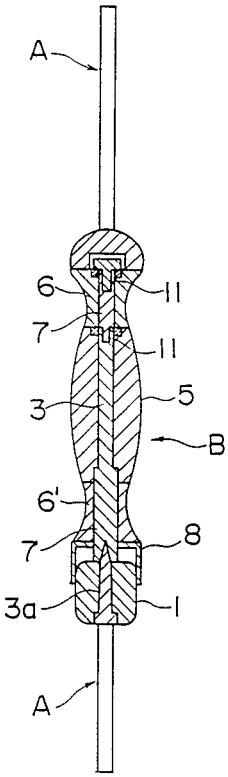

FIGS. 11 and 12 show another embodiment, which is featured in location of the handle B. That is, in preceding examples, the handle is not disposed across a weight balancing line, as seen in FIGS. 8–10. This point is improved by bending the shaft 1*a* so as to locate the handle B in a balanced location about the line G with one end holding or in cantilever form.

FIG. 12 shows sectional view of the handle B of which internal structure is similar to FIG. 6, and 11, 11 indicate internal thread engagements.

Figure 13:
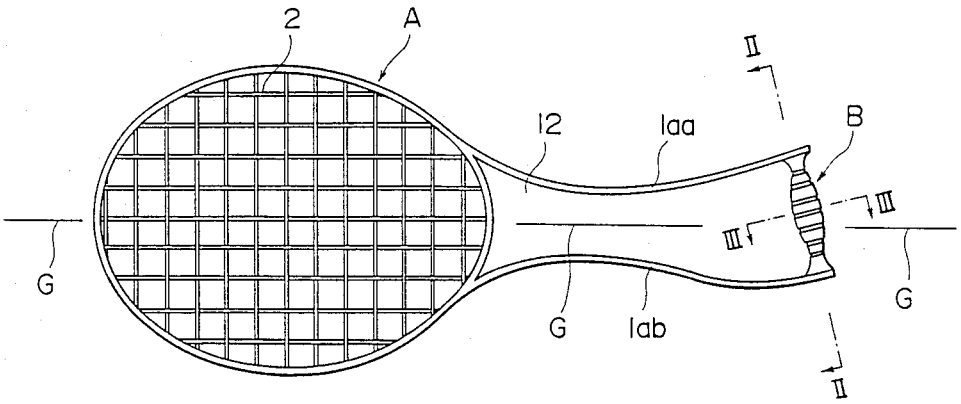
Figure 14:
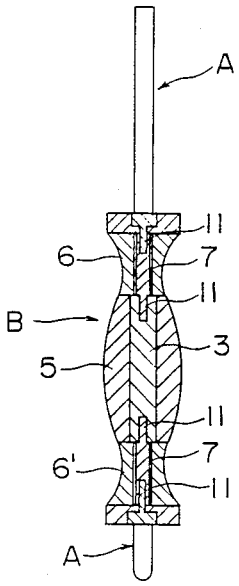
Figure 15:
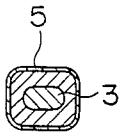

FIGS. 13–15 show still another embodiment, which is featured in bifurcating the shaft 1*a* to two sub-shafts 1*aa*, 1*ab*, and disposing the handle B at a transverse angle with respect to the line G so as to ease a user's suspension by the hand.

FIG. 14 shows a sectional view of the handle B, of which internal structure is similar to FIG. 6.

Figure 16:
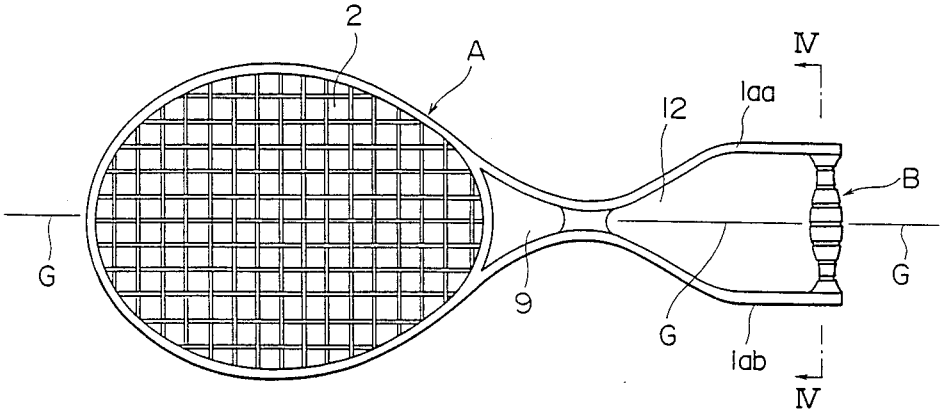
Figure 17:
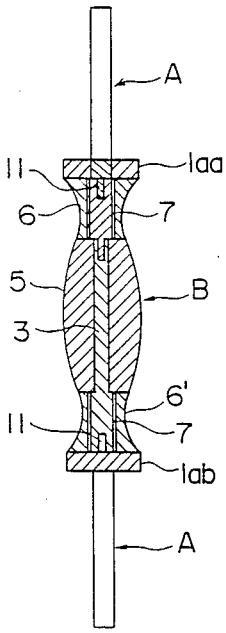

FIGS. 16 and 17 show still further another embodiment, which is featured in bifurcating the shaft 1*a* to two sub-shafts 1*aa*, 1*ab*, and disposing the handle B in a balance location to be evenly across the line G with two ends holding or in bridge form.

FIG. 17 shows sectional view of the handle B, of which internal structure is similar to FIG. 6.

Another common feature in structuring the rackets shown in FIGS. 13 to 17 lies in provision of an opening 12 around the handle B, thereby a air resistance to swing motions will be reduced.

In the description above, the handle B is explained as a part of a racket, but the handle B, itself or independently of a racket body, conventionally accepted form, is of use which is ready to be fitted to a conventional racket. Fitting of a handle unit to a racket is achieved by a converntional coupling art.

What is claimed is:

1. A racket with a rotary crosshandle, said racket comprising a racket body, the racket body comprising a racket frame and a racket shaft extending from the racket frame, said racket shaft being provided with the rotary crosshandle, said rotary crosshandle being disposed substantially on a plane defined by the racket body and having a length substantially equal to the width of a man's palm; said crosshandle comprising an internal shaft having at least one end thereof secured to the racket shaft, the internal shaft being sheathed with a plurality of grip members, said grip members being stacked relative to each other with rotary interslidability to form an axial length of said crosshandle, at least one of the stacked grip members being mounted rotatable relative to the internal shaft and the remainder of said plurality of grip members being mounted stationary relative to the internal shaft; whereby swing motions of the racket are controlled by manual touch onto the grip members stationary and rotatably mounted relative to the internal shaft.

2. A racket with a rotary crosshandle as defined by claim 1, wherein one end of said internal shaft is secured to the racket shaft with said crosshandle extending substantially perpendicular to the racket shaft and said crosshandle and said racket frame are disposed on opposite sides of a longitudinal racket line (G) extruding through said racket shaft and a straight side of said racket frame, whereby said crosshandle is disposed to counterbalance the racket body disposed on the opposite side of said longitudinal racket line (G).

3. A racket with a rotary crosshandle as defined by claim 1, wherein one end of said internal shaft is secured to the racket shaft with said crosshandle extruding substantially perpendicular to the racket shaft, said racket body is balanced on opposite sides of a longitudinal racket line (G) and said crosshandle is disposed to provide a biasing counterbalance to the racket body.

4. A racket with a rotary crosshandle as defined by claim 1, wherein a first portion of said racket shaft extends from said frame along a longitudinal racket line (G), a second portion of said racket shaft is bent and laterally displaced from said first portion of said racket shaft and one end of said internal shaft is secured to the second portion of said racket shaft with said crosshandle extending substantially perpendicular to said second portion of said racket shaft and traversing said longitudinal racket line (G).

5. A racket with a rotary crosshandle as defined by claim 1, wherein said racket shaft is bifurcated to provide two sub-shafts and opposite ends of said internal shaft are each secured to one of said sub-shafts with said crosshandle disposed to traverse a longitudinal racket line (G) at an angle.

6. A racket with a rotary crosshandle as defined by claim 5 wherein said crosshandle traverses said longitudinal racket line (G) at an angle which is substantially perpendicular to said longitudinal racket line (G).

7. A racket with a rotary crosshandle as defined by claim 1, wherein the plurality of grip members are comprised of two grip members with one grip member being rotatable relative to the internal shaft and the other grip member being stationary relative to the internal shaft.

8. A racket with a rotary crosshandle as defined by claim 1, wherein the plurality of grip members are comprised of three grip members stacked on said internal shaft, a center one of said three grip members is mounted stationary relative to said internal shaft and the two grip members on opposite sides of said center grip member are mounted to be rotatable relative to said internal shaft.

9. A racket with a rotary crosshandle as defined by claim 1, wherein one of said plurality of grip members comprises a main grip member and said main grip member has a circular cross-section.

10. A racket with a rotary crosshandle as defined by claim 1, wherein one of said plurality of grip members comprises a main grip member and said main grip member has an elongate, non-circular cross-section.

* * * * *

UNITED STATES PATENT AND TRADEMARK OFFICE

CERTIFICATE OF CORRECTION

PATENT NO. : 4,978,123

DATED : December 18, 1990

INVENTOR(S) : ASHIHARA

It is certified that error appears in the above-identified patent and that said Letters Patent is hereby corrected as shown below:

ON TITLE PAGE: Item [76], "Hiyuki Ashihara" should read --Hideyuki Ashihara--;

In the Abstract, Item [57], line 1, delete "isoffered" and insert therefor --is offered--;

Line 10, delete "are" and insert therefor --art--.

Signed and Sealed this

Eighteenth Day of August, 1992

*Attest:*

DOUGLAS B. COMER

*Attesting Officer*

*Acting Commissioner of Patents and Trademarks*